US009121664B2

(12) United States Patent
Fitzpatrick et al.

(10) Patent No.: US 9,121,664 B2
(45) Date of Patent: Sep. 1, 2015

(54) FOREND FOR A PUMP ACTION FIREARM

(71) Applicant: Magpul Industries Corporation, Erie, CO (US)

(72) Inventors: Richard Fitzpatrick, Longmont, CO (US); Michael T. Mayberry, Denver, CO (US); Brad Bennett, Lafayette, CO (US); Thomas Ward, Denver, CO (US); Chad McKonoly, Boulder, CO (US)

(73) Assignee: Magpul Industries Corporation, Louisville, CO (US)

( * ) Notice: Subject to any disclaimer, the term of this patent is extended or adjusted under 35 U.S.C. 154(b) by 42 days.

(21) Appl. No.: 14/094,176

(22) Filed: Dec. 2, 2013

(65) Prior Publication Data

US 2015/0128467 A1 May 14, 2015

Related U.S. Application Data

(60) Provisional application No. 61/902,005, filed on Nov. 8, 2013.

(51) Int. Cl.
*F41C 23/16* (2006.01)
*F41C 7/02* (2006.01)

(52) U.S. Cl.
CPC .. *F41C 23/16* (2013.01); *F41C 7/02* (2013.01)

(58) Field of Classification Search
CPC ..... F41C 23/16; F41C 25/08; F41C 23/14
USPC ..... 42/71.01, 75.01, 75.03, 87, 72
See application file for complete search history.

(56) References Cited

U.S. PATENT DOCUMENTS 2,023,929 A * 12/1935 Loomis ..... 42/17
3,242,608 A * 3/1966 Heppard ..... 42/71.01

(Continued)

FOREIGN PATENT DOCUMENTS

FR 2751062 5/1996
WO WO 2004/085950 10/2004

OTHER PUBLICATIONS

BravoCompanyUSA_com_2007_M4_Hand_Gaurd BravoCompanyUSA.com (Oct. 15, 2007) M4 Hand Gaurd; Website [Online] Available Web Site: http://www.bravocompanyusa.com/M4-Handguards-Black-p/bcm%20handguard%20m4%20black.htm; Last Update: Feb. 19, 2008; Accessed on Feb. 23, 2011.

(Continued)

*Primary Examiner* — Samir Abdosh
*Assistant Examiner* — John D Cooper
(74) *Attorney, Agent, or Firm* — Swanson & Bratschun, L.L.C.

(57) ABSTRACT

A forend for use with a pump action firearm having a barrel with a magazine tube arranged adjacent and parallel thereto. The pump action firearm further includes an action slide assembly slidably receiving the magazine tube and the action slide assembly has a distal end and an action slide cap configured to engage the distal end of the action slide assembly. The forend comprises an elongate body having a U-shaped cross-section configured to be secured to the action slide assembly by an action slide cap engaged to a distal end of the action slide assembly. A guide defining a barrel receptacle is configured for keyed engagement to an interior of the elongate body to prevent rotational movement of the guide relative to the elongate body with the barrel receptacle facing toward the top of the U-shaped cross-section of the body. The barrel receptacle is configured to nest a radial portion of a barrel exterior, wherein the guide limits axial rotation of the forend about the magazine tube relative to the barrel.

14 Claims, 5 Drawing Sheets

(56) References Cited

U.S. PATENT DOCUMENTS

| | | | | |
|---|---|---|---|---|
| 3,512,290 | A * | 5/1970 | La Violette, Jr. et al. | 42/75.01 |
| 3,892,082 | A | 7/1975 | Domhan | |
| 4,406,080 | A * | 9/1983 | Badali | 42/75.01 |
| 4,536,982 | A | 8/1985 | Bredbury | |
| 4,663,875 | A | 5/1987 | Tatro | |
| D297,450 | S | 8/1988 | Florida | |
| 5,010,676 | A | 4/1991 | Kennedy | |
| 5,054,221 | A | 10/1991 | Ozols | |
| 5,305,539 | A | 4/1994 | von Kuster | |
| 5,983,773 | A | 11/1999 | Dionne | |
| 6,243,978 | B1 * | 6/2001 | Vignaroli et al. | 42/17 |
| 6,609,321 | B2 | 8/2003 | Faifer | |
| 6,662,485 | B2 | 12/2003 | Kay | |
| D486,547 | S | 2/2004 | Faifer | |
| 6,775,941 | B1 | 8/2004 | McNulty, Jr. | |
| D507,619 | S | 7/2005 | Shiloni | |
| 7,121,035 | B2 | 10/2006 | Greer | |
| 7,194,834 | B2 | 3/2007 | Falenwolfe | |
| 7,571,671 | B2 | 8/2009 | Engel | |
| D615,142 | S | 5/2010 | Bentley | |
| 7,866,079 | B2 | 1/2011 | Keeney | |
| D641,450 | S | 7/2011 | Ding | |
| 8,051,595 | B2 | 11/2011 | Hochstrate | |
| D656,215 | S | 3/2012 | Fitzpatrick | |
| D672,838 | S | 12/2012 | Mayberry | |
| 8,448,367 | B2 | 5/2013 | Samson | |
| 8,522,468 | B2 | 9/2013 | Webber | |
| 2010/0059032 | A1 | 3/2010 | Zadra | |
| 2011/0119982 | A1 * | 5/2011 | Webber et al. | 42/75.03 |
| 2012/0144712 | A1 | 6/2012 | Rostocil | |
| 2014/0157639 | A1 | 6/2014 | Larson | |
| 2014/0196342 | A1 * | 7/2014 | Syrengelas et al. | 42/71.01 |

OTHER PUBLICATIONS

Bushmaster_com_ACR_Accessories_Polymer_Hand_Guard Bushmaster.com, ACR Accessories—Polymer Hand Guard—Carbine—Black; Website [Online] Available Web Site: http://www.bushmaster.com/products.asp?cat=11; Last Update: unknown; Accessed on Feb. 23, 2011.

Bushmaster_com_Disassembly_Views_AR15_Rifle Bushmaster.com ; Disassembly Views of the Bushmaster AR15 Rifle; Website [Online] Available Web Site: http://www.bushmaster.com/documentation/AR51%20PBRifleBBLAssembly.pdf; Last Update: unknown; Accessed on May 9, 2011.

Bushmaster_com_2007_Schematic_Parts_Poster_M4A3_Carbine Bushmaster.com (2007) Schematic Parts Poster for Bushmaster M4A3 Carbine; Website [Online] Available Web Site: http://www.bushmaster.com/electronic-documents/2007Catalogv1/Page40-41Schematic2007.pdf; Last Update: unknown; Accessed on May 9, 2011.

DSArms_com_SA58_FAL_Spartan_Tactical_Rifle DSArms.com, SA58 FAL Spartan Tactical Rifle .308 Caliber—SA58SPNTAC; Website [Online] Available Web Site: http://www.dsarms.com/SA58-FAL-Spartan-Tactical-Rifle-308-Caliber—SA58SPNTAC/productinfo/SA58SPNTAC/; Last Update: unknown; Accessed on Feb. 23, 2011.

Mossberg_Owners_Manual_PartNo_12173_Rev_H Mossberg Owners Manual for 500, 835 and 590 Model Pump Action Shotguns, Part No. 12173, Rev. H.

Design U.S. Appl. No. 29/379,439, filed Nov. 19, 2010, "Hand Guard for a Firearm" by Fitzpatrick.

Design U.S. Appl. No. 29/401,634, filed Sep. 13, 2011, "Forend for a Firearm" by Mayberry.

Krebs_Custom_2014_KV-13 Krebs Custom (Sep. 10, 2014) Krebs Custom KV-13; Website [Online] Available Website: http://www.krebscustom.com/kv-13.aspx; Last Update: Unknown; Accessed on: Mar. 6, 2014.

Krebs_Custom_2013_AK_Forend Krebs Custom (Dec. 26, 2013) AK Forend; Website [Online] Available Website: http://www.krebscustom.com/ak-forend.aspx; Last Update: Unknown; Accessed on: Mar. 6, 2015.

Design U.S. Appl. No. 29/459,580, "Firearm Foregrip" filed Jul. 1, 2013.

Design U.S. Appl. No. 29/500,587, "Firearm Foregrip" filed Aug. 26, 2014.

Design U.S. Appl. No. 29/487,942, "Hand Guard for a Firearm" filed Apr. 14, 2014.

Design U.S. Appl. No. 29/511,748, "Hand Guard for a Firearm" filed Dec. 12, 2014.

Design U.S. Appl. No. 29/511,753, "Hand Guard Upper for a Firearm" filed Dec. 12, 2014.

Design U.S. Appl. No. 29/511,760, "Hand Guard for a Firearm" filed Dec. 12, 2014.

Design U.S. Appl. No. 29/511,992, "Hand Guard for a Firearm" filed Dec. 16, 2014.

* cited by examiner

FOREND FOR A PUMP ACTION FIREARM

RELATED APPLICATIONS

This application claims priority to U.S. Provisional Patent Application No. 61/902,005, filed Nov. 8, 2013, which is incorporated herein by reference in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

TECHNICAL FIELD

The present invention is directed toward pump action firearms, and more particularly toward a forend for a pump action firearm adaptable to barrels of varying diameters.

BACKGROUND

A variety of pump action firearms are known. One variety of pump action firearms are Mossberg pump action shotguns manufactured by O.F. Mossberg & Sons, Inc., which include the model 500, 835 and 590 pump action shotguns, among others. Each of these models of the Mossberg pump action shotgun are of the same basic configuration and include a barrel with a magazine tube arranged adjacent and parallel thereto extending from a receiver. An action slide assembly is axially received on the magazine tube and includes a pair of action bars which are received in the receiver. The action bars are attached to the action slide assembly in a manner permitting some pivoting about a horizontal axis at the point of attachment. The standard Mossberg 500, 835 and 590 model pump action shotguns further include a forend consisting of an elongate body having a U-shaped cross-section and an integrally formed internal frame which axially receives the slide action assembly. The top portion of the internal frame defines a pair of angled shelves. These angled shelves are configured so that with the forend axially received on the slide action assembly and with the forend attached to the slide action assembly by an action slide tube nut threadably engaging a threaded distal end of the action slide assembly, the angled shelves snuggly nest the outer diameter of the barrel which overlies the magazine tube. The slide action assembly is slid along the magazine tube to chamber a round by action of the action bars within the receiver. Because the action bars of the action slide assembly are pivotably attached to the action slide assembly as discussed above and because the action bars are relatively flexible members, a close tolerance between the angled shelves and the barrel is necessary to limit rotation of the forend about the magazine tube axis relative to the barrel. Typically the barrel is at least slightly tapered from a larger diameter at the receiver to a narrower diameter near distal end. Ideally the angled shelves touch the barrel at least when the forend is near the receiver and the proximal end of the barrel. Rotation of the forend about the magazine tube is highly undesirable as it can overstress the action bars with prolonged use and can cause the forend to have a sloppy feel during actuation.

One problem with the design of the forend for the Mossberg 500, 835 and 590 model pump action shotguns is that barrels with different outer diameters at the receiver and the distal end may be used with the various models. As a result, in order to maintain an acceptable tolerance between the angled shelves of the forend and various barrels of different outer diameter at the receiver and the distal end used with the respective models, a distinct forend having angled shelves configured to nest a particular barrel outer diameter profile must be used with each barrel having a different outer diameters at the receiver and distal ends so as to limit relative rotation between the forend and the barrel. As a result, Mossberg and providers of after-market forends compatible with Mossberg pump action shotguns must provide different forends for each different diameter profile of the barrels compatible with the different Mossberg models or hazard a sloppy feel of the forend.

The present invention is directed toward overcoming one or more of the problems discussed above.

SUMMARY OF THE EMBODIMENTS

A first aspect is a forend for use with a pump action firearm having a barrel with a magazine tube arranged adjacent and parallel thereto. The pump action firearm further includes an action slide assembly slidably receiving the magazine tube and the action slide assembly has a distal end and an action slide cap configured to engage the distal end of the action slide assembly. The forend comprises an elongate body having a U-shaped cross-section and a cylindrical frame attached to the inside of the body configured to axially receive an action slide assembly of a firearm. The elongate body is further configured to be secured against axial lengthwise movement relative to the action slide assembly by an action slide cap releasably engaged to a distal end of the action slide assembly. A guide defining a barrel receptacle is configured for keyed engagement to an interior of the elongate body to prevent rotational movement of the guide relative to the elongate body with the barrel receptacle facing toward the top of the U-shaped cross-section of the body. The barrel receptacle is configured to nest a radial portion of a barrel exterior, wherein the guide limits axial rotation of the forend about the magazine tube relative to the barrel.

In one embodiment the forend comprises more than one guide configured for keyed engagement to the elongate body, with each guide having a distinct barrel receptacle configured to nest with a barrel of a select outer diameter near its proximal end. Such an embodiment allows a guide to be selected from the more than one guide having receptacle corresponding to an outer diameter of an associated barrel to nest a radial portion of the barrel exterior, wherein the select guide limits axial rotation of the forend about the magazine tube axis relative to the barrel. Certain embodiments include the guide comprising an integrally formed ring axially receiving the magazine tube, the barrel receptacle being defined in a radial portion of the ring. Embodiments may include the guide being axially secured to the forend by the action slide cap. Embodiments may include the barrel receptacle being defined between a pair of spaced projections and the spaced projections engage radially spaced portions of the barrel exterior.

Another aspect of the invention is a pump action firearm comprising a barrel and a magazine tube arranged adjacent and parallel to the barrel. An action slide assembly slidably receives the magazine tube and the action slide assembly has a distal end and an action slide cap configured to engage the distal end of the action slide assembly. The firearm further comprises a forend including an elongate body configured to extend lengthwise along an axis of the magazine tube. The elongate body has a U-shaped cross-section with an open top of the U adjacent to the barrel. The inside of the body is configured to axially receive the action slide assembly and to be secured against axial lengthwise movement relative to the action slide assembly by the action slide cap. A guide is configured for keyed engagement to the interior of the elongate body to prevent rotational movement of the guide relative to the elongate body. The guide defines a barrel receptacle facing toward the top of the U-shaped cross-section of the body configured to nest a radial portion of the barrel exterior, wherein the guide limits axial rotation of the forend about the magazine tube axis relative to the barrel.

Embodiments of this aspect may include more than one guide configured for keyed engagement to the elongate body, with each guide having a distinct barrel receptacle configured to nest with a barrel of a select outer diameter at its proximal end. In this manner, a guide can be selected from the more than one guide having a barrel receptacle corresponding to an outer diameter of an associated barrel to nest a radial portion of the barrel exterior, wherein the select guide limits axial rotation of the forend about the magazine tube relative to the barrel. Embodiments may also include the guide comprising an integrally formed ring axially receiving the magazine tube, the barrel receptacle being defined in a radial portion of the ring. Embodiments may include the guide being axially secured to the forend by the action slide cap. Embodiments may also include a frame attached to the inside of the body defining a cylindrical receptacle for the action slide assembly. Embodiments may include the barrel receptacle being defined at least in part by a pair of radially spaced projections.

Another aspect is a method of attaching a forend to an action slide assembly of a pump action shot gun of the type having a barrel with a magazine tube arranged adjacent and parallel thereto, the action slide assembly receiving the magazine tube and being slideable axially thereof. The method comprises providing a forend having an elongate body configured to extend lengthwise of an axis of a magazine tube, the elongate body having a U-shaped cross-section with an open top of the U and an internal frame configured to axially receive an action slide assembly. The method further includes providing a plurality of guides, each guide being configured to be removably keyed to the interior of the elongate body of the forend to limit rotational movement of the guide relative to the elongate body. Each guide defines a barrel receptacle facing toward the top of the U-shaped cross-section with the guide keyed to the interior of the elongate body. The barrel receptacle is configured to nest a radial portion of a barrel exterior. In this manner the guide limits axial rotation of the forend relative to the barrel. Each guide has a distinct configuration of the barrel receptacle so that each guide can nest a barrel exterior of a barrel having a corresponding outer diameter. The method further comprises selecting a guide of the plurality of guides each having a barrel receptacle corresponding to the outer diameter of a barrel of the pump action shot gun. A distal end of the slide tube assembly is axially inserted into the internal frame of the forend. The selected guide is keyed to the interior of the elongate body with the barrel receptacle positioned to nest a radial portion of the corresponding barrel exterior. The selected guide is then axially secured to the forend.

Embodiments of the method may further include each of the plurality of guides comprising an integrally formed ring, with the barrel receptacle being defined in a radial portion of each ring. In such embodiments the selected guide is keyed to the interior of the elongate body by a step including axially receiving the action slide assembly within the ring. Embodiments may also include the action slide assembly having a distal end and action slide cap configured for releasable engagement to the distal end of the action slide assembly. The selected guide is axially secured to the forend and the forend is secured to the action slide assembly by engagement of the action slide cap with the action slide assembly. Embodiments may also include the internal frame defining a cylindrical receptacle axially receiving the magazine tube. The internal frame may be integrally formed with the forend body.

Various modifications and additions can be made to the embodiments discussed without departing from the scope of the invention. For example, while the embodiments described above refer to particular features, the scope of this invention also included embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION

While various aspects and features of certain embodiments have been summarized above, the following detailed description illustrates a few embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
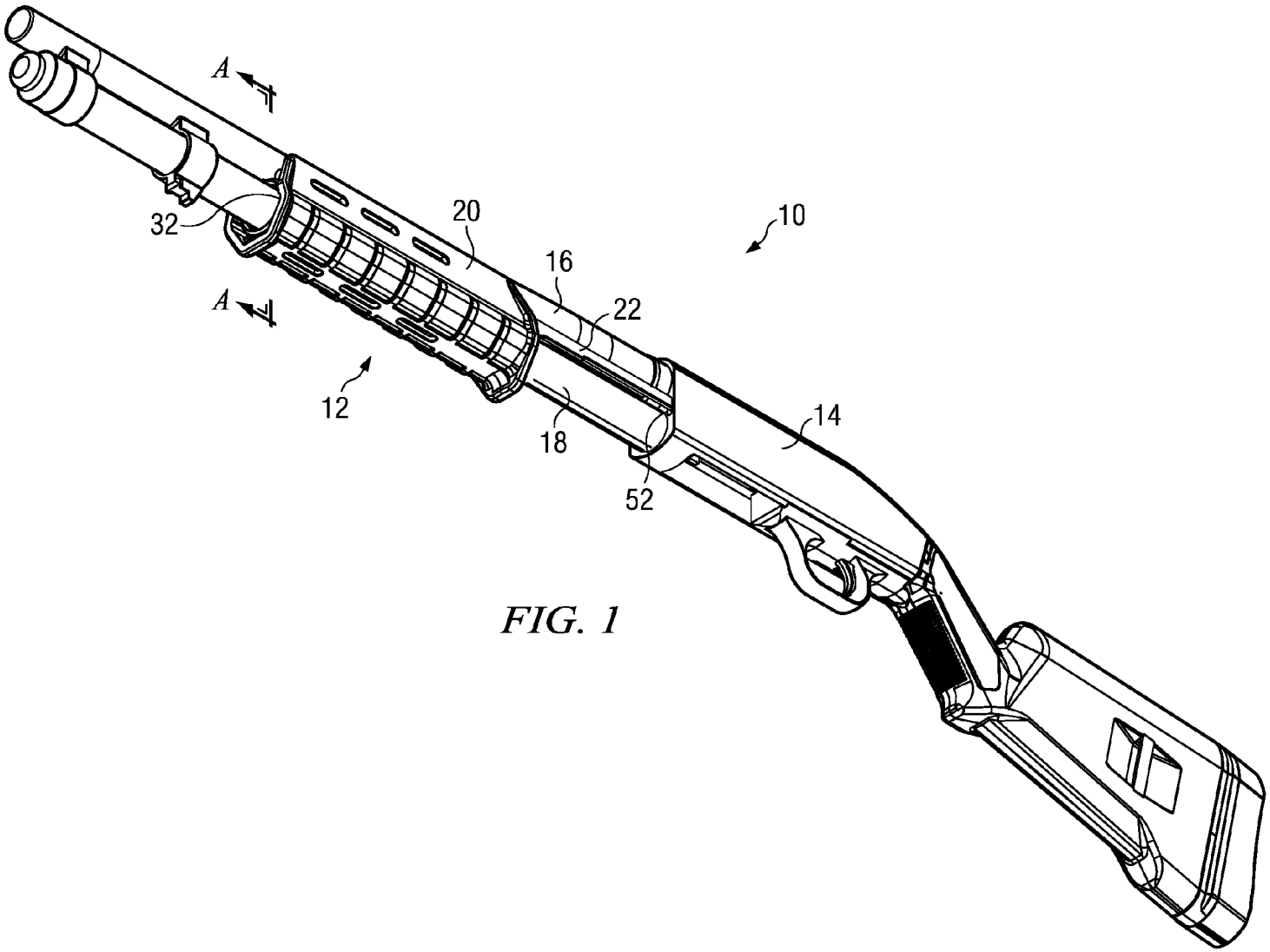
FIG. 1 is a perspective view of a pump action firearm with a forend in accordance with various embodiments disclosed herein attached to a slide action assembly of the pump action shotgun.
Figure 2:
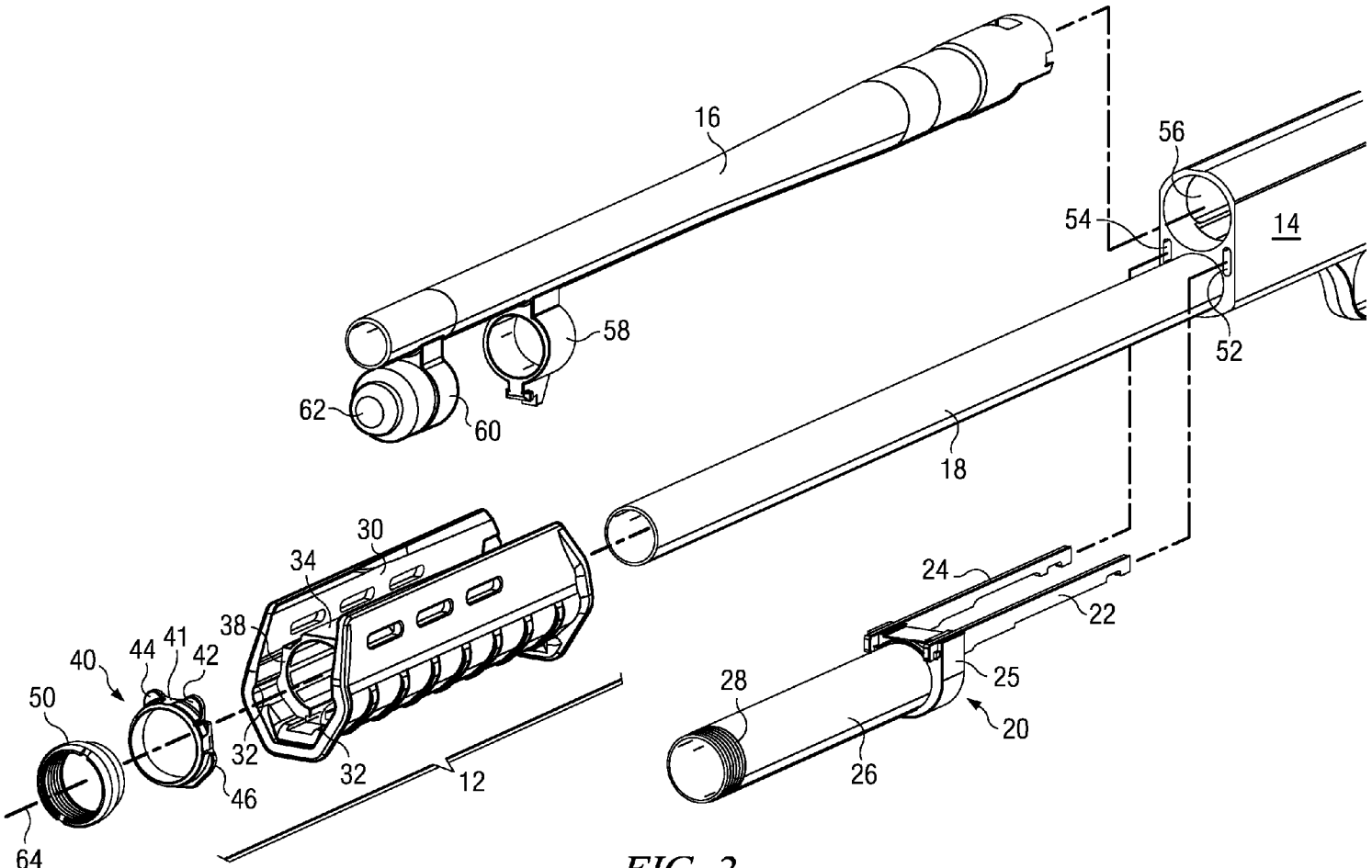
FIG. 2 is an exploded view of the barrel assembly, slide action assembly and forend in accordance with various embodiments disclosed herein.

FIG. 1 is a perspective view of a pump action firearm 10 including a forend 12 in accordance with the embodiments as described herein. The pump action firearm 10 as illustrated is a Mossberg pump action shotgun 590 model. It is to be understood that the forend in accordance with the embodiments described herein could also be used with the Mossberg 835, 500 or other models and even other brand firearms having a slide action assembly. The pump action firearm 10 includes a receiver 14 receiving a barrel 16 and a magazine tube 18 attached thereto. As seen in FIG. 2, the barrel has a relatively large outer diameter near the receiver or proximal end and tapers slightly toward the distal end or muzzle to a smaller diameter. The forend 12 receives an action slide assembly 20 having a pair of action bars 22, 24 extending from a fitting 25 at one end of a cylindrical body 26 and having an externally threaded second or distal end 28. The action slide assembly 20 is best viewed in its entirety in FIGS. 2-4. The action bars 22, 24 are attached at their proximal ends to the fitting 25 by horizontal pins (as depicted in FIG. 2) that allow limited vertical pivoting of the action bars 22, 24 relative to the cylindrical body 26. Though not shown, leaf springs can be provided in operative association with the action bars to bias them to pivot downward as viewed in FIG. 2. In FIG. 1, only the action bar 22 of the action slide assembly 20 is visible. It can be seen that the action bar 22 is received in the receiver 14 through the slot 52 with the action slide assembly 20 axially receiving the magazine tube 18 through the cylindrical body 26. As is well known in the art, the action slide assembly 20 can slide relative to the magazine tube 18 to drive the action bars 22, 24 in and out of the receiver 14 for the purpose of chambering rounds contained in the magazine tube 18 within the receiver 14.

Figure 3:
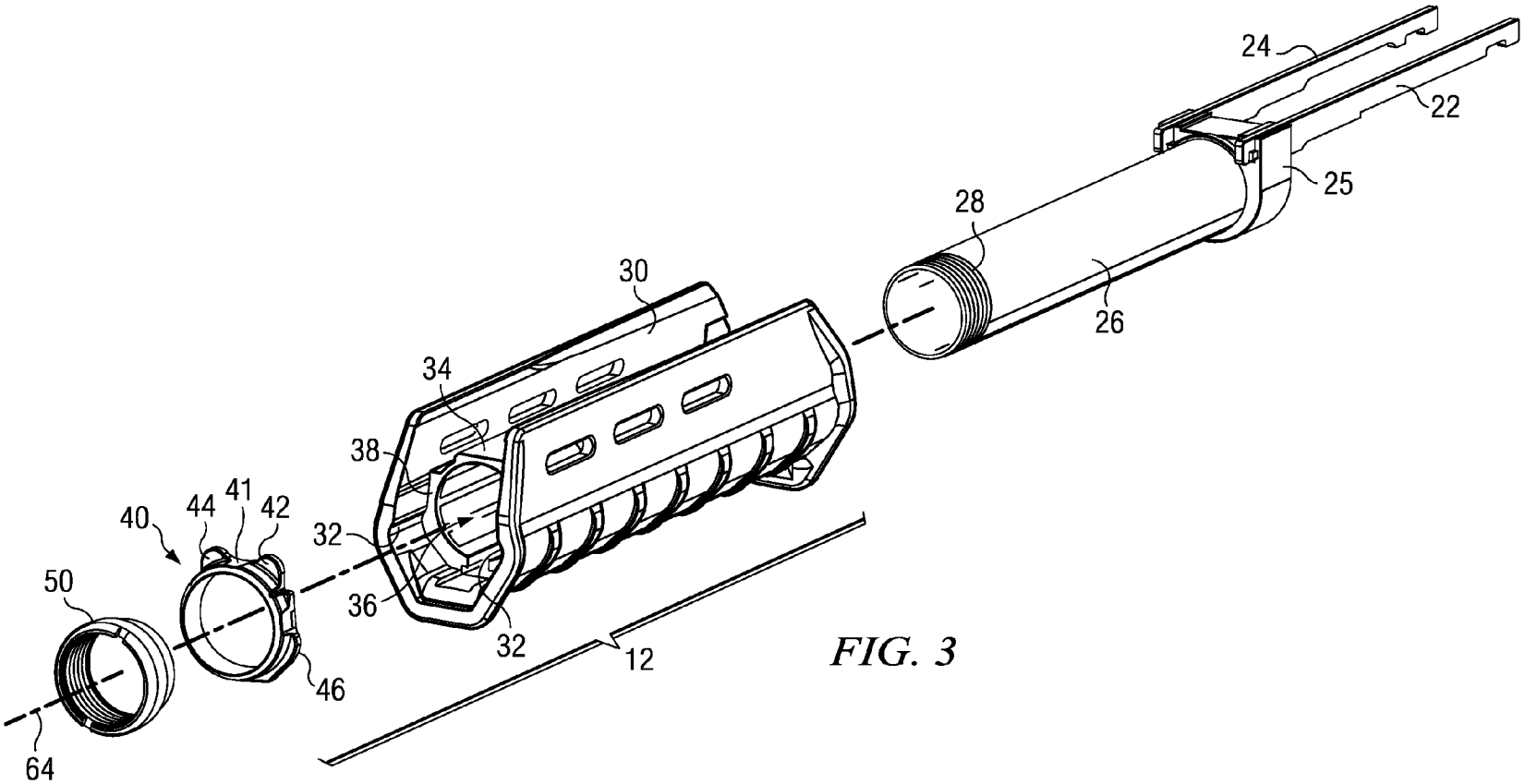
FIG. 3 is an exploded view of the slide action assembly and forend in accordance with various embodiments disclosed herein.

The forend 12 is best viewed in its partially exploded state shown in FIGS. 2 and 3. The forend 12 includes an elongate body 30 having a U-shaped cross-section as viewed in FIGS. 2-6. The interior of the elongate body 30 defines opposing lengthwise recess channels 32. A frame 34 defining a cylindrical receptacle 36 is mounted inside the U-shaped interior of the elongate body 30. In the embodiment illustrated herein the frame 34 is integrally molded as a single piece with the elongate body 30. Alternatively the frame 34 may be a separate element that is fixed in place by any suitable means including adhesives, heat staking, fasteners or the like.

The forend 12 further includes a guide 40 defining a barrel receptacle 41 configured to nest a radial portion of the barrel 16. In the embodiment illustrated herein, the barrel receptacle is defined between a pair of spaced projections 42, 44. The guide 40 further includes guide protrusions 46 which are configured to be snuggly received in the lengthwise recess channels 32 formed inside the elongate body 30 to form a keyed fitting preventing relative rotation between the guide 40 and the elongate body 30. In the embodiment illustrated in FIG. 3, guide 40 is integrally formed in a ring configuration sized to axially receive the cylindrical body 26 of the action slide assembly 20 and the spaced projections 42, 44 extend radially from the ring.

Figure 4:
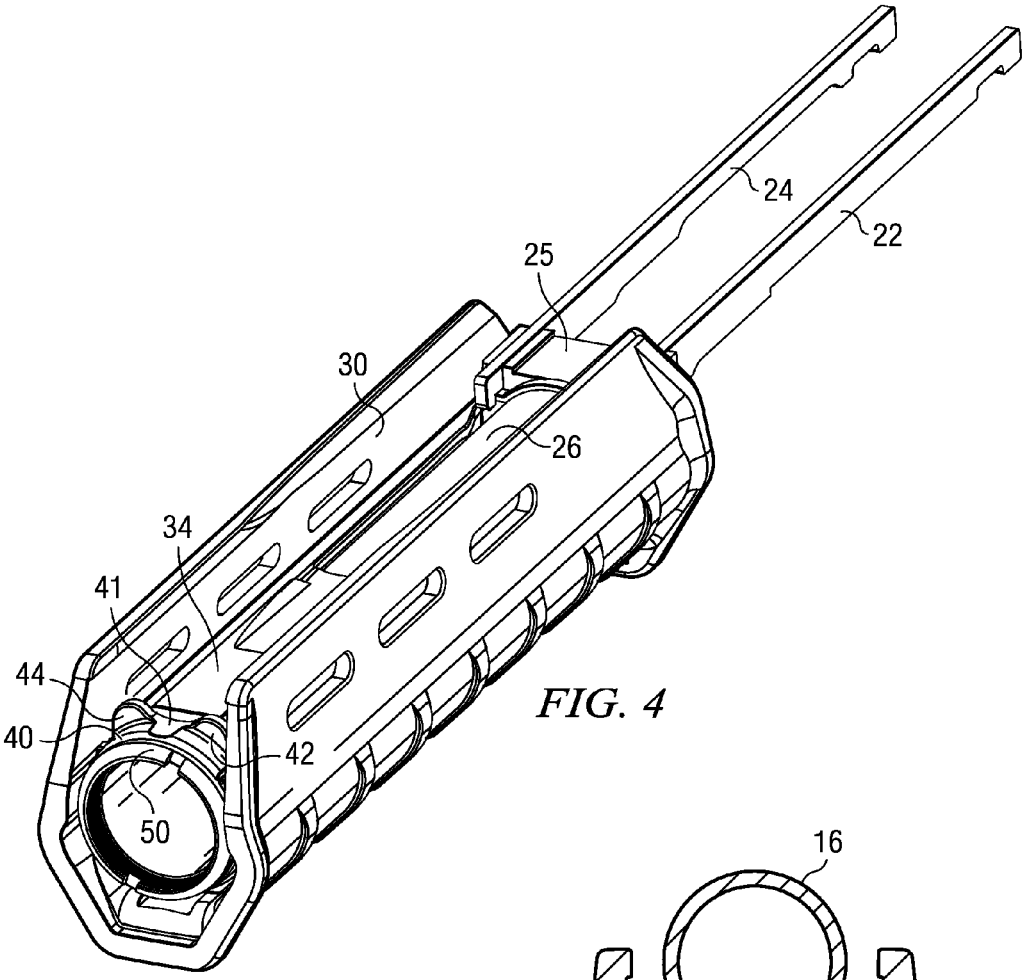
FIG. 4 is a perspective assembled view of a forend in accordance with various embodiments disclosed herein axially receiving and attached to a slide action assembly.

When assembled as illustrated in FIG. 4, the cylindrical body 26 of the action slide assembly 20 is axially received in the cylindrical receptacle 36 defined by the frame 34 in the interior of the elongate body 30. The proximal end of the interior of the elongate body 30 is configured to mate with the fitting 25 from which the action bars 22, 24 extend. The guide 40 is engaged to the interior of the elongate body 30 by mating the guide protrusions 46 with the lengthwise recess channels 32 with the barrel receptacle 41 defined at least in part by the spaced projections 42, 44 facing toward the top of the U of the elongate body 30 (see FIGS. 5 and 6) and the forend 12 is secured to the action slide assembly 20 by an action slide cap 50 with internal threads which releasably threadably engage the threaded distal end 28 of the cylindrical body 26 of the action slide assembly 20. Alternative embodiments may have a have a cylindrical body 26 without a threaded distal end 28, and instead of an action slide cap with internal threads, an action slide cap being otherwise configured to fixedly or releasably engage the distal end 28. For example, the slide cap may comprise a twist top or plastic snap tab. With the forend 12 attached to the action slide assembly 20 as described, the action slide assembly 20 slidably axially receives the magazine tube 18 with the action bars 22, 24 being received in slots 52, 54 of the receiver 14. Thereafter the barrel 16 is received in the barrel hole 56 of the receiver 14 with a first bracket 58 and a second bracket (or take down mount ring) 60 receiving the magazine tube 18 and a magazine cap 62 engaged to a distal end of the magazine tube 18.

Figure 5:
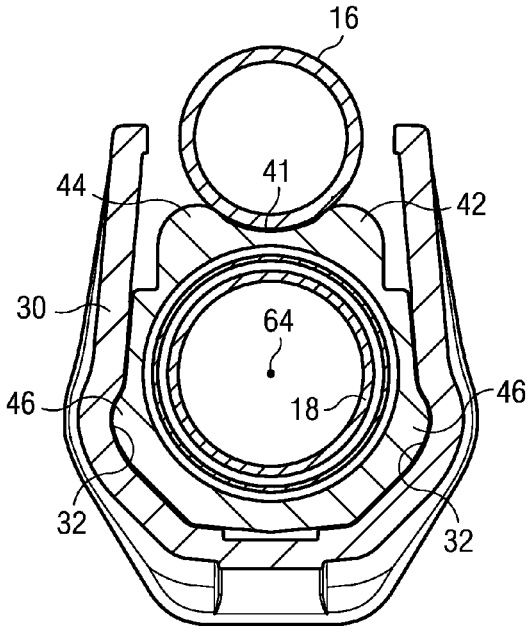
FIG. 5 is a cross-section of forend in accordance with various embodiments disclosed herein attached to a pump action firearm taken along lines A-A of FIG. 1.

As viewed in FIG. 5, the barrel receptacle 41 is defined between the spaced projections 42, 44 spaced a distance to nest a radial portion of the barrel 16. By "nest" we mean being positioned to contact or provide a small clearance between the radial portion of the barrel 16 so as to limit rotation of the forend 12 about the magazine axis 64 during actuation of the slide action assembly 20. As should be apparent, because the barrel 16 is tapered from a smaller diameter near the muzzle to a larger diameter near the receiver, the small clearance will be present near the muzzle with the slide action assembly not actuated and the guide 40 at is most distal position relative to the barrel and clearance will be smaller or eliminated with the slide action assembly slid into the receiver and the guide closer to the larger diameter or proximal end of the barrel. However, regardless of the location of the guide along the length of the barrel it functions to limit rotation of the forend relative to the barrel and may substantially eliminate rotation of the forend relative to the barrel when it is near the proximal end of the barrel.

Figure 6:
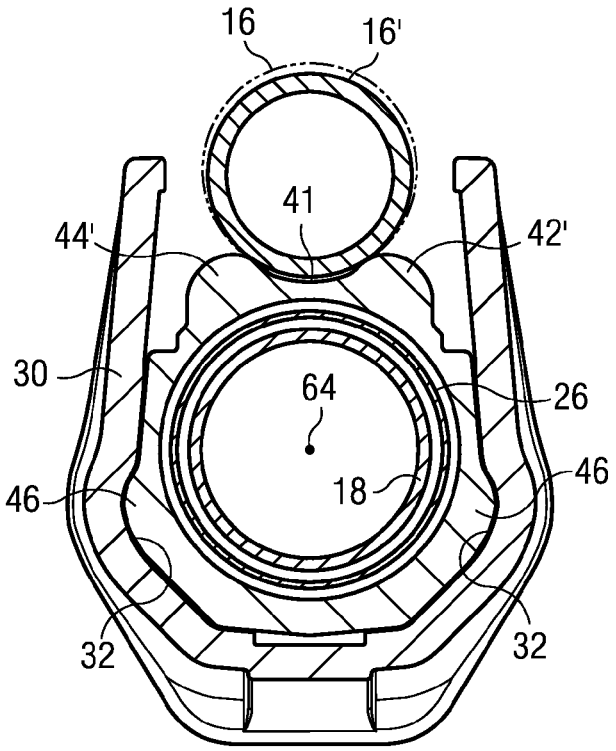
FIG. 6 is identical to FIG. 5, only showing a guide having a distinct smaller barrel receptacle for nesting a barrel of a different smaller diameter than the barrel depicted in FIG. 5.
Figure 7:
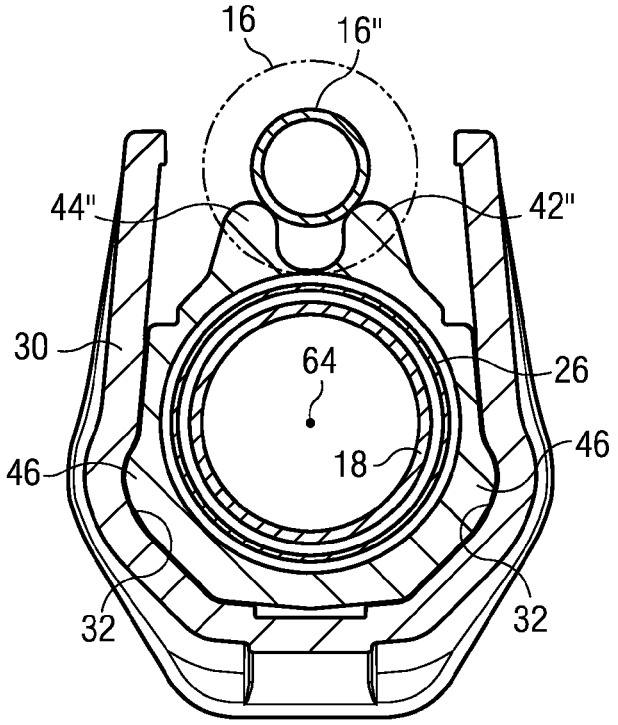
FIG. 7 is identical to FIG. 5, only showing a guide having a barrel receptacle for nesting a barrel of a substantially smaller diameter than the barrel depicted in FIG. 5.

In order to allow the forend 12 to be attached to pump action firearms having barrels 16 of varying diameters, a number of guides 40 are provided that are otherwise identical to the guide 40 illustrated in FIGS. 2-5, but having a differently configured barrel receptacles to accommodate barrels of differing diameters. For example, in the embodiment illustrated herein, the distance between the spaced projections 42, 44 may vary. This may be desirable in one specific example, where, as illustrated, the forend 12 is to be used for Mossberg pump action shotguns models 500, 835 and 590, with barrels having a different outer diameter. Thus, for example, as illustrated in FIG. 6, where the barrel 16' has a smaller outer diameter than the outer diameter of the barrel 16 shown in broken lines in FIG. 6, the spaced projections 42', 44' are spaced closer together to nest the smaller diameter barrel 16'. Likewise, FIG. 7 illustrates a barrel 16" with a much smaller outer diameter than the outer diameter of the barrel 16 shoen in broken lines in FIG. 7, the spaced projections 42", 44" being spaced considerably closer to nest the smaller diameter barrel 16". While in the particular embodiment illustrated herein only three guides 40 are shown having different spaced projections 42, 44, as many different guides as may be necessary or desired to accommodate many different outer diameter barrels is within the scope of the embodiments disclosed herein. Further the invention is not limited to the barrel receptacle being defined between projections 42, 44, but extends to any manner of forming a barrel receptacle in the guide 40.

The description of the various embodiments has been presented for purposes of illustration and description, but is not intended to be exhaustive or limiting of the invention to the form disclosed. The scope of the present invention is limited only by the scope of the following claims. Many modifications and variations will be apparent to those of ordinary skill in the art. The embodiments described and shown in the figures were chosen and described in order to explain the principles of the invention, the practical application, and to enable others of ordinary skill in the art to understand the invention for various embodiments with various modifications as are suited to the particular use contemplated. All references cited herein are incorporated in their entirety by reference.

What is claimed is:

1. A forend for use with a pump action firearm having a barrel with a magazine tube arranged adjacent and parallel thereto, an action slide assembly slidably receiving the magazine tube, the action slide assembly having a distal end and an action slide cap configured to engage the distal end of the action slide assembly, the forend comprising:

an elongate body having a U-shaped cross-section and a cylindrical frame attached to the inside of the body configured to axially receive an action slide assembly of a firearm, the elongate body further being configured to be secured against axial lengthwise movement relative to the action slide assembly by an action slide cap engaged to a distal end of the action slide assembly; and more than one guide, each guide defining a barrel receptacle configured to nest a radial portion of a firearm barrel adjacent a magazine tube, each guide further being configured for keyed engagement to the elongate body to prevent rotational movement of the guide relative to the elongate body with the barrel receptacle facing toward the top of the U-shaped cross-section of the body, with each guide having a distinct barrel receptacle configured to nest with a barrel of a select outer diameter near a proximal end, wherein a guide can be selected from the more than one guide having a barrel receptacle corresponding to an outer diameter of an associated barrel to nest a radial portion of the barrel exterior, wherein the select guide limits axial rotation of the forend relative to the barrel with the barrel nested in the barrel receptacle and the guide in keyed engagement to the interior of the elongate body.

2. The forend of claim 1 wherein the guide comprises an integrally formed ring axially receiving the magazine tube, the barrel receptacle being defined in a radial portion of the ring.

3. The forend of claim 1 wherein the barrel receptacle is defined by a pair of spaced projections.

4. The forend of claim 1 wherein the elongate body and the cylindrical frame are integrally formed.

5. A pump action firearm comprising:

a barrel:

a magazine tube arranged adjacent and parallel to the barrel;

an action slide assembly slidably receiving the magazine tube, the action slide assembly having a distal end and an action slide cap configured to engage the distal end of the action slide assembly; and a forend comprising:

an elongate body configured to extend lengthwise along an axis of the magazine tube, the elongate body having a U-shaped cross-section with an open top of the U adjacent to the barrel, the inside of the body being configured to axially receive the action slide assembly and to be secured against axial lengthwise movement relative to the action slide assembly by the action slide cap; and more than one guide, each guide defining a barrel receptacle configured to nest a radial portion of a firearm barrel adjacent a magazine tube, each guide further being configured for keyed engagement to the interior of the elongate body to prevent rotational movement of the guide relative to the elongate body with the barrel receptacle facing toward the top of the U-shaped cross-section of the body, with each guide having a barrel receptacle configured to nest with a barrel of a select outer diameter at its proximal end, wherein a guide can be selected from the more than one guide having barrel receptacle corresponding to an outer diameter of an associated barrel to nest a radial portion of the barrel exterior, wherein the select guide limits axial rotation of the forend relative to the barrel with the barrel nested in the barrel receptacle and the guide in keyed engagement to the interior of the elongate body.

6. The pump action firearm of claim 5 wherein the guide comprises an integrally formed ring axially receiving the magazine tube, the barrel receptacle being defined in a radial portion of the ring.

7. The pump action firearm of claim 6 wherein the guide is axially secured to the forend by the action slide cap.

8. The pump action firearm of claim 5 wherein the barrel receptacle is defined by a pair of spaced projections.

9. The pump action firearm of claim 5 wherein the elongate body comprises a frame attached to the inside the body defining a cylindrical receptacle for the action slide assembly.

10. The forend pump action firearm of claim 9 wherein the elongate body and the cylindrical frame are integrally formed.

11. A method of attaching a forend to an action slide assembly of a pump action firearm of the type having a barrel with a magazine tube arranged adjacent and parallel thereto, the action slide assembly receiving the magazine tube and being slideable axially thereof, the method comprising:

providing a forend having an elongate body configured to extend lengthwise of an axis of a magazine tube, the elongate body having a U-shaped cross-section with an open top of the U and an internal frame configured to axially receive an action slide assembly;

providing a plurality of guides, each guide being configured to be removably keyed to the interior of the elongate body of the forend to prevent rotational movement of the guide relative to the elongate body, each guide further defining a barrel receptacle facing toward the top of the U-shaped cross-section with the guide keyed to the interior of the elongate body, the barrel receptacle being configured to nest a radial portion of a barrel exterior, wherein the guide limits axial rotation of the forend relative to the barrel, each guide having a distinct barrel receptacle configuration so that each guide can nest a radial portion of a barrel exterior of a barrel having a corresponding outer diameter;

selecting a guide of the plurality of guides having a barrel receptacle corresponding to the outer diameter of a barrel of the pump action firearm;

axially inserting a distal end of the action slide assembly into the internal frame of the of the forend;

keying the selected guide to the interior of the elongate body with the barrel receptacle positioned to nest a radial portion of the barrel exterior; and axially securing the selected guide to the forend.

12. The method of claim 11 wherein each of the plurality of guides comprises an integrally formed ring, the barrel receptacle being defined in a radial portion of the ring, the method further comprising the step of keying the selected guide to the interior of the elongate body including axially receiving the action slide assembly within the ring.

13. The method of claim 12 wherein a distal end of the action slide assembly is threaded and an action slide tube nut is provided for theadable engagement to the action slide assembly, the method further comprising axially securing the selected guide to the forend and securing the forend to the action slide assembly by the action slide tube nut.

14. The method of claim 11 wherein the internal frame defines a cylindrical receptacle axially receiving the action slide assembly.

* * * * *